US006660708B2

(12) United States Patent
Kaess

(10) Patent No.: US 6,660,708 B2
(45) Date of Patent: Dec. 9, 2003

(54) PROCESS FOR PREPARING FLUID DETERGENT COMPOSITIONS

(75) Inventor: André Kaess, Mannheim (DE)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 56 days.

(21) Appl. No.: 09/835,129

(22) Filed: Apr. 12, 2001

(65) Prior Publication Data

US 2001/0031718 A1 Oct. 18, 2001

(30) Foreign Application Priority Data

Apr. 12, 2000 (GB) ..... 0009087

(51) Int. Cl.[7] ..... C11D 11/04

(52) U.S. Cl. ..... 510/450; 510/290; 510/357; 510/444; 510/426; 510/435; 510/509; 510/536

(58) Field of Search ..... 510/290, 357, 510/444, 450, 426, 435, 509, 536

(56) References Cited

U.S. PATENT DOCUMENTS

| | | | | |
|---|---|---|---|---|
| 4,668,438 A | | 5/1987 | Pierr et al. | 260/400 |
| 6,387,868 B1 | * | 5/2002 | Uno et al. | 510/426 |

FOREIGN PATENT DOCUMENTS

| | | | |
|---|---|---|---|
| EP | 367 339 | | 5/1990 |
| EP | 507 402 | | 10/1992 |
| GB | 608 943 | | 9/1948 |
| WO | 93/23520 | * | 11/1993 |
| WO | 98/11193 | * | 3/1998 |
| WO | 98/11197 | * | 3/1998 |

OTHER PUBLICATIONS

PCT International Search Report in a PCT application PCT/EP 01/02810.
Derwent Abstract of JP 02 218656.
GB Search Report in a GB application 0009087.8.

* cited by examiner

*Primary Examiner*—Charles Boyer
(74) *Attorney, Agent, or Firm*—Rimma Mitelman

(57) ABSTRACT

A process for the preparation of fluid detergent product comprising an anionic surfactant in which the acid precursor of the anionic surfactant is fed through at least two mixing devices, sufficient neutralising agent to neutralise 25–75 wt % of the acid precursor being fed to the first mixing device, and sufficient neutralising agent to complete neutralisation being added to the mixture from the first mixing device to substantially complete neutralisation by the time the process stream exits the final mixing device, wherein the initial liquid component and the process stream are kept at pumpable temperature at all times during the process.

16 Claims, No Drawings

PROCESS FOR PREPARING FLUID DETERGENT COMPOSITIONS

FIELD OF THE INVENTION

The present invention relates to a process for preparing fluid detergent compositions comprising an anionic surfactant. More particularly, it relates to a process for the continuous preparation of a fluid detergent composition comprising an anionic surfactant, formed by neutralisation of its anionic surfactant acid precursor, and an nonionic surfactant.

BACKGROUND OF THE INVENTION

In the manufacture of detergent compositions containing anionic surfactants, the anionic surfactants are often manufactured via and supplied in their acid form. There are several reasons for this, including the fact that certain anionic surfactants, for example linear alkylbenzene sulphonates, are much easier to handle, store and transport in their acid form as compared with the neutralised form. The anionic surfactant acid precursors are then converted into their corresponding surfactant salts by neutralisation with either aqueous or dry neutralising agents.

One of the most common pieces of plant set up for carrying out neutralisation of anionic surfactant acid precursors is a loop reactor. The anionic surfactant acid precursor, neutralising agent and other diluents/buffers are injected into the loop reactor, usually at a common point, and blended by an in-line mixer present in the loop. The heat of neutralisation is typically removed by a pipe bundle heat exchanger in the loop.

An inherent problem with neutralisation reactions is how to deal with the large amount of heat generated. Overheating (i.e. "hot-spots") and the long residence time can lead to discoloration of the product. Loop reactors address the problem of overheating by only removing a small fraction of the product flow, for example 5–10%, from the loop, whilst the recirculating mixture, generally in the form of a paste, acts as a heat sink, preventing a large rise in temperature at the injection point. This method of operation means that neutralisation in a loop reaction is a highly inefficient process.

Many fully neutralised anionic surfactants tend to become highly viscous pastes which are difficult to handle. For this reason, neutralisation is very often carried out in the presence of other liquid detergent components such as nonionic surfactants. However, there is a problem with discoloration of the anionic/nonionic surfactant mixture as a result of the anionic surfactant acid precursor reacting with the nonionic surfactant. It is therefore desirable that the time over which the anionic surfactant acid precursor, prior to neutralisation, is in contact with the nonionic surfactant is short. The very design and operation of neutralisation loop reactors means that any nonionic surfactant is going to be in contact with anionic surfactant acid precursor for a considerable period of time as it recirculates in the loop and more acid is added to be neutralised.

Finally, the start-up (i.e. up to the point where a "steady-state" recirculation is achieved) and the shut-down procedures for neutralisation in a loop reactor are long and time-consuming, with the material being produced during these procedures being outside of specification.

There was therefore a need for the development of a simple process for neutralising an anionic surfactant acid precursor, in particular in the presence of a nonionic surfactant, which:

(i) does not involve a recirculation loop;

(ii) is relatively quick;

(iii) effectively inhibits the generation of hot-spots;

(iv) is efficient in terms of start-up and shut-down;

(v) avoids the production of outside of specification material at start-up and shut-down, and (vi) ensures full neutralisation of the anionic surfactant acid precursor.

PRIOR ART

EP 507 402 (Unilever) describes a process for preparing a liquid surfactant composition comprising anionic surfactant, nonionic surfactant and having a relatively low water content, wherein essentially equimolar amounts of neutralising agent and liquid anionic surfactant acid precursor are blended simultaneously with the nonionic surfactant. The surfactant mixtures can be prepared in a batch process in which equimolar amounts of the anionic precursor and neutralising agent are added to a reaction vessel containing the required amount of nonionic surfactant. Alternatively, and preferably, the process is carried out continuously in a loop reactor. The liquid surfactant compositions may additionally contain a fatty acid, and may be applied in a process for making high bulk density granular detergent compositions having a high active detergent level, as disclosed by EP 367 339 (Unilever).

WO93/23520 (Henkel) describes a method for preparing anionic surfactant containing granular washing compositions comprising (i) partially or completely neutralising one or more anionic surfactant acid precursors with an inorganic or organic neutralising agent to produce an anionic-containing mixture which is flowable/pumpable up to at least 20° C., and (ii) mixing and granulating the anionic-containing mixture with a particulate material in a mixer. For partial neutralisation in step (i), the level neutralisation in step (i) is preferably from 20–40%. The anionic surfactant acid precursor is preferably mixed with a nonionic surfactant in step (i).

Surprisingly, we have now found that a fluid detergent product comprising an anionic surfactant can be prepared in a simple continuous process without the need for a loop reactor by passing the anionic surfactant acid precursor through at least two mixers in series, an initial portion of neutralising agent being fed to the first mixer and further neutralising agent being fed to the subsequent mixer or mixers to complete neutralisation. It is essential, in order for the process to work efficiently, that the process mixture be cooled after addition of the initial portion of neutralising agent and before further neutralising agent is added, and, that the temperature of the mixture be maintained at a level which allows the mixture to be readily pumpable.

Thus the present invention allows fluid detergent products containing anionic surfactant to be prepared from anionic surfactant acid precursors in a simple single pass process. This is far more efficient than a loop reactor operation and has relatively short start-up and shut-down times. In addition, if nonionic surfactant is present during the neutralisation reaction, the present invention ensures it is not exposed to the anionic surfactant acid precursor for too long a period.

DEFINITION OF THE INVENTION

In a first aspect, this invention provides a continuous process for the preparation of a fluid detergent product containing an anionic surfactant, comprising mixing an initial liquid component comprising the anionic surfactant acid precursor with sufficient neutralising agent to substantially complete neutralisation of the anionic surfactant acid precursor characterised in that:

(i) the initial liquid component is fed to a first mixing device with sufficient initial neutralising agent to neutralise 25–75 wt % of the anionic surfactant acid precursor, and (ii) the partially neutralised process stream from step (i) is fed through one or more subsequent mixing devices with sufficient further neutralising agent to substantially complete neutralisation by the time the process stream exits the final mixing device, wherein the process stream comprising the initial neutralising agent is actively cooled by a cooling means prior to the addition of any further neutralising agent, and the initial liquid component and process stream are kept at a temperature above the pumpable temperature at all times during the process.

DETAILED DESCRIPTION OF THE INVENTION

Definitions

The "pumpable temperature" as herein defined is the temperature at which a fluid exhibits a viscosity of 1 Pa.s at 50 $s^{-1}$. In other words, fluids are considered readily pumpable if they have a viscosity of no greater than 1 Pa.s at a shear rate of 50 $s^{-1}$ at the temperature of pumping. Fluids of higher viscosity may still in principle be pumpable, but an upper limit of 1 Pa.s at a shear rate of 50 $s^{-1}$ is used herein to indicate easy pumpability. The viscosity can be measured, for example, using a Haake VT500 rotational viscometer. The viscosity measurement may be carried out as follows. A SV2P measuring cell is connected to a thermostatic water bath with a cooling unit. The bob of the measuring cell rotates at a shear rate of 50 $s^{-1}$. The fluid, which may be in a solid form at ambient temperature, is heated in a microwave to 95° C. and poured into the sample cup. After conditioning for 5 minutes at 98° C., the sample is cooled at a rate of +/−1° C. per minute. The temperature at which a viscosity of 1 Pa.s is observed, is recorded as the "pumpable temperature".

As used herein, a constituent, component, mixture or product is considered "pumpable" if it has a viscosity of no more than 1 Pa.s at a shear rate of 50 $s^{-1}$ and a temperature of at least 50° C., preferably at least 60° C., as measured by the method described above. If a constituent, component, mixture or product has a viscosity of more than 1 Pa.s at a shear rate of 50 $s^{-1}$ and a temperature of at least 120° C., preferably at least 110° C., more preferably at least 100° C., then is considered not to be pumpable.

As used herein, the term "process stream" is taken to mean any mixture comprising the initial liquid component and some neutralising agent.

Hereinafter, in the context of this invention, the term "fluid detergent product" encompasses finished products for sale, as well as fluid components or adjuncts for forming finished products, e.g. by post-dosing such fluid components or adjuncts or any other form of admixture to or with further fluid or particulate components or adjuncts.

Hereinafter, in the context of this invention, the term "granular detergent product" encompasses granular finished products for sale, as well as granular components or adjuncts for forming finished products, e.g. by post-dosing such granular components or adjuncts or any other form of admixture to or with further components or adjuncts.

Thus a granular detergent product as herein defined contains anionic surfactant at a level of at least 5 wt %, preferably at least 10 wt % of the product.

As used hereinafter, the term "powder" refers to materials substantially consisting of grains of individual materials and mixtures of such grains. As used hereinafter, the term "granule" refers to a small particle of agglomerated smaller particles, for example, agglomerated powder particles. The final product of the process according to the present invention consists of, or comprises a high percentage of granules. However, additional granular and or powder materials may optionally be post-dosed to such a product.

As used herein, the terms "granulation" and "granulating" refer to a process in which, amongst other things, particles are agglomerated.

The Process

The process of the invention is carried out using at least two mixing devices in series.

Mixing Devices

Suitable mixing devices will be well-known to the skilled person. They have to be capable of operating in a continuous process and of mixing fluids. Suitable mixers include static in-line mixers, for example Sulzer-type mixers, and dynamic in-line mixers, for example rotor-stator dynamic mixers.

The initial liquid component comprising the anionic surfactant acid precursor is fed to the first mixing device together with neutralising agent. The initial liquid component and neutralising agent can be fed as separate streams to the first mixing device or alternatively can be brought into contact with each other prior to the mixing device. In the case of the latter arrangement, the two streams should only be brought together at a position relatively close, in terms of time, to the mixing device. Preferably the time between the two streams being brought together and the combined stream entering the mixing device should be less than 3 minutes, preferably less than 1 minute.

The partially neutralised process stream leaving the first mixing device is fed into one or more subsequent mixing devices. Sufficient neutralising agent is added to the process stream so that the mixture exiting the final mixing device is substantially fully neutralised. When neutralising agent is added to the process stream from the first mixing device, it is either added as a separate stream to a subsequent mixing device or alternatively is brought into contact with the process stream prior to a subsequent mixing device. In the case of the latter arrangement, the two streams should only be brought together at a position relatively close, in terms of time, to the mixing device. Preferably the time between the two streams being brought together and the combined stream entering the mixing device should be less than 3 minutes, preferably less than 1 minute.

If more than one subsequent mixing device is used, the mixing devices are preferably in series. However, it is envisaged that the process stream from the first mixing device could be split into two or more process streams. These "parallel" steams could then be treated (i.e. neutralised) separately and, optionally, recombined.

Of course, in the case of more than two mixing devices, it will be understood that neutralising agent does not have to be added to the process stream prior to or within every mixing device, so long as the total amount of neutralising agent added is sufficient to allow the process stream exiting the final mixing device to be substantially fully neutralised.

In a preferred embodiment, the process stream from the first mixing device is fed through just one other mixing device and sufficient neutralising agent is added to the process stream entering the second mixing device or directly to the second mixing device so that the process stream exiting the second mixing device is substantially fully neutralised.

At the very minimum, the process requires anionic surfactant acid precursor and neutralising agent as starting materials, which are of course stored in separate vessels. However, the fluid detergent product can also contain other constituents in addition to anionic surfactant. Such additional constituents, or their precursors, which make up the fluid detergent product are preferably stored separately from the anionic surfactant acid precursor, neutralising agent and each other. This allows a greater variety of fluid detergent products to be prepared from the same starting materials.

Preferably, the anionic surfactant acid precursor, neutralising agent and any additional constituents can be fed from their respective storage vessels into the process independently of each other. Additional constituents can be fed into the process at any appropriate stage, e.g. into the initial liquid component, the process stream and/or a mixing device.

Although the various constituents (or precursors thereof) of the fluid detergent product may be fed into the process by means of gravity, it is preferred, in the case of components which are pumpable, that a pump device be used, preferably a positive displacement pump. Suitable pumps for this purpose include, for example, gear pumps and mono pumps.

When the initial liquid component contains other constituent(s) in addition to the anionic surfactant acid precursor, the various constituents are preferably brought together and mixed with the anionic surfactant acid precursor in an additional process step preceding the first mixing device. Suitable mixers for such additional process steps include those described for the mixing devices (supra).

Alternatively, if the constituents permit, it may be possible to premix two or more constituents (e.g. as a batch) and feed the premixture from a single storage vessel into the process.

The mixing devices are typically connected via appropriate pipelines. In order to facilitate the passage of the initial liquid component and process stream along the pipelines and through the mixing devices, pumps may are used. Some mixing devices can provide a pumping action in addition to a mixing action; e.g. rotor-stator dynamic in-line mixers.

Alternatively, the pumping action imparted on the system by the pumps used to deliver the constituent components to the process may be sufficient for the process to operate.

Neutralisation

Sufficient initial neutralising agent is added to the initial liquid being fed to the first mixing device to neutralise 25–75 wt %, preferably 30–70 wt %, more preferably 35–65 wt % of the anionic surfactant acid precursor. Sufficient further neutralising agent to complete neutralisation is then added to the process stream from the first mixing device to substantially complete neutralisation by the time the process stream exits the final mixing device.

It is important that sufficient further neutralising agent be added to ensure complete neutralisation of the anionic surfactant acid precursor. If desired, a stoichiometric excess of neutralising agent may be employed to ensure complete neutralisation. For example, a 0.1 to 1.0% excess over and above that required for complete neutralisation may be added. If any other acids are present, such as for example fatty acids, that require neutralisation, the amount of neutralising agent should be adjusted accordingly.

The further neutralising agent added to the process stream leaving the first mixing device can be added in one or more points in the process. Preferably it is added at a single point.

The initial neutralising agent added to the initial liquid component can be the same or different from the neutralising agent(s) used in the remaining of the process to complete neutralisation.

Neutralisation Time

The period of time from first contacting neutralising agent with the initial liquid component, to the process stream exiting the final mixing device is herein referred to as the "neutralisation time". This can be measured for example by dividing the plant throughput by the plant volume.

The neutralisation time for preparation of a fully neutralised and good quality (i.e. low levels of decomposition etc.) fluid detergent product is dependent amongst other things on the correct temperature control (as discussed below) and the plant set up and equipment used.

Typically, the neutralisation time is less than 5 minutes. Preferably, it is less than 3 minutes, and times as low as 1 minute can be achieved.

Temperature Control

The initial liquid component and the process stream, including the process stream exiting the final mixing device, are maintained at a temperature above the pumpable temperature at all times during the process. Therefore, it is important to monitor and if necessary control the temperature and thus the viscosity of the initial liquid component and the process stream whilst the process is in operation to ensure they are both pumpable.

Furthermore, it is also preferred that any other constituents which are to be incorporated into the process are maintained at a temperature above their respective pumpable temperatures when the process is in operation. Of course this does not apply in the case of any constituents which are solids or which are not pumpable.

As constituents (or precursors thereof) are mixed in the process, the pumpable temperature can increase dramatically. For example, neutralised anionic surfactants are often viscous pastes whereas anionic surfactant acid precursors are often readily pumpable liquids. Thus as neutralising agent is added to the initial liquid component, there is typically an increase in the pumpable temperature. However, the neutralisation reaction generates its own heat so it is not necessarily a requirement that the process stream be heated at this point in the process. In fact, we have found that it is an essential requirement of the neutralisation process that the process stream be actively cooled after addition of the initial portion of neutralising agent and prior to the addition of further neutralising agent. This is because, the addition of further neutralising agent is going to generate more heat and it is important that the initial liquid component and process stream does not reach too high a temperature or this can lead to evaporation of water or even decomposition of the anionic surfactant or acid precursor. Furthermore, if cooling is allowed to occur passively as opposed to being actively undertaken, the residence time of the process has to be significantly increased in order to maintain the temperature during the process at an acceptable level.

In a preferred embodiment, the temperature of the initial liquid component and the process stream is maintained below 120° C., preferably below 110° C., more preferably below 100°, and yet more preferably below 95° C.

It is clear from the above discussion that the temperature of the initial liquid component and process stream needs to be carefully monitored and controlled if necessary by means of heating and cooling means. In is also possible to incorporate feedback control systems into the process. For example, a temperature measuring device downstream of a cooling device can feedback readings to the cooling device and vary the level of cooling so as to maintain the temperature within a predetermined range.

Of course, once the fluid detergent product has exited the final mixing device (i.e. the process has been completed) it can be allowed to cool to a temperature below its pumpable temperature. Indeed, the use of a "structured blend" (see below) which is pumpable at elevated temperatures and yet solid at lower temperatures is a preferred embodiment of this invention. However, even when the fluid detergent product is of the structured blend type, it is preferred to maintain the fluid detergent product at a temperature above its pumpable temperature so it can be applied directly as, for example, a liquid binder in a granulation process without the need for reheating.

Heating Means

Heating means may be positioned anywhere in the process to ensure a particular fluid component or mixture is above its pumpable temperature. Suitable heating means will be apparent to the skilled person.

Cooling Means

Suitable cooling means will be well known to the skilled person and include, for example, pipe bundle heat exchangers and plate heat exchangers.

It is an essential feature of the present invention that at least one cooling means is provided through which the process stream, comprising the initial liquid component and the initial portion of neutralising agent, passes prior to the addition of any further neutralising agent. The cooling means may be positioned before, within or after the first mixing device as is appropriate. Preferably, it is positioned after the first mixing device.

Further cooling means may be positioned anywhere in the process as is appropriate to control the temperature. It is particularly preferred to position further cooling means in a position where the process stream is likely to be particularly hot, e.g. due to exothermic heat generated by neutralisation. Thus, it is preferred that a cooling means be positioned downstream of the point of addition of neutralising agent and preferably upstream of the point of addition of any further neutralising agent. Suitably, cooling means are positioned after a mixing device where either neutralising agent has been fed into that mixing device or to the process stream entering that mixing device.

The entire neutralisation process is continuous. Thus, as will be apparent to the skilled person, the mixing devices, cooling means and, where appropriate, heating means should be suitable for a continuous process.

The process of this invention has been found to produce fluid detergent products of excellent color. In other words, there is little or no discoloration as a result of the process. Furthermore, the process of the invention is highly efficient in terms of the neutralisation reaction, and little or no unreacted acid is found to be present in the product.

The start-up procedure is far simpler than that involved in a loop recirculation system as there is no need to wait for a steady state to develop. In addition, shut-down procedure is much simpler, as there amount of material in the system when it is in operation is far less than that in a loop system. The material produced during start-up and shut-down is also substantially of the required specification.

The Fluid Detergent Product

This invention provides a process in which an initial liquid component containing the anionic surfactant acid precursor is mixed with sufficient neutralising agent to fully neutralise the anionic surfactant acid precursor.

Anionic Surfactant

The fluid detergent product contains an anionic surfactant. Suitable anionic surfactants are well-know to those skilled in the art. Examples suitable for incorporation into the fluid detergent product include alkylbenzene sulphonates, particularly linear alkylbenzene sulphonates having an alkyl chain length of $C_8$–$C_{15}$; primary and secondary alkyl sulphates, particularly $C_{12}$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred. It is an essential element of the process of this invention that at least a portion, and preferably a substantial portion, of the anionic surfactant in the fluid detergent product be formed via neutralisation of an anionic surfactant acid precursor. Preferably, at least 50 wt %, more preferably at least 75 wt %, and yet more preferably substantially all of the anionic surfactant present in the fluid detergent product is obtained by neutralisation of anionic surfactant acid precursor.

The content of anionic surfactant in the fluid detergent product may be as high as possible, e.g. at least 98 wt % of the fluid detergent product, or it may be less than 75 wt %, less than 50 wt % or less than 25 wt %. Preferably, it is at least 10 wt %, more preferably at least 25 wt %, more preferably at least 50 wt %, and yet more preferably at least 60 wt % of the fluid detergent product.

The initial liquid component comprises at least some anionic surfactant acid precursor. Preferably, the liquid component comprises at least 70 wt %, more preferably 90 wt %, yet more preferably substantially all of the anionic surfactant acid precursor to be neutralised in the process.

Suitable anionic surfactant acid precursors include, for example, linear alkyl benzene sulphonic (LAS) acids, alpha-olefin sulphonic acids, internal olefin sulphonic acids, fatty acid ester sulphonic acids and combinations thereof. The process of the invention is especially useful for producing compositions comprising alkyl benzene sulphonates by reaction of the corresponding alkyl benzene sulphonic acid, for instance Dobanoic acid ex Shell. Linear or branched primary alkyl sulphates (PAS) having 10 to 15 carbon atoms can also be used.

The content of anionic surfactant acid precursor in the initial liquid component is preferably at least 10 wt %, more preferably at least 25 wt %, more preferably at least 50 wt %, and yet more preferably at least 60 wt % of the initial liquid component. It may be as high as possible, e.g. at least 95 wt % of the liquid component.

Some of the anionic surfactant present in the final fluid detergent product may be incorporated by direct addition of anionic surfactant at an appropriate stage in the process. However, if the initial liquid component contains anionic surfactant (i.e. a neutral salt), it accounts for less than 50 wt %, preferably for less than 25 wt %, and more preferably less than 10 wt % of the liquid component.

Nonionic Surfactant

In a preferred embodiment, the fluid detergent product comprises an anionic surfactant and a nonionic surfactant.

The nonionic surfactant component of the fluid detergent product may be any one or more liquid nonionics selected from primary and secondary alcohol ethoxylates, especially $C_8$–$C_{20}$ aliphatic alcohols ethoxylated with an average of from 1 to 20 moles ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

The weight ratio of anionic surfactant to nonionic surfactant in the fluid detergent product is preferably no greater than 10:1, more preferably no greater than 5:1, and still more preferably no greater than 4:1. Furthermore, the weight ratio of anionic surfactant to nonionic surfactant in the liquid component is preferably no less than 1:15, more preferably no less than 1:10, still more preferably no less than 1:5, and even more preferably no less than 1:2. It should be noted that in specifying any particular preferred range herein, no particular upper limit is associated with any particular lower limit.

The nonionic surfactant can be added at any appropriate stage in the process. However, if present, it is preferred to incorporate at least some, and preferably substantially all of the nonionic surfactant to the initial liquid component.

Thus, in another preferred embodiment, the initial liquid component comprises a nonionic surfactant. The preferred weight ratios given above for anionic surfactant to nonionic surfactant in the fluid detergent product also apply to the ratio of anionic surfactant acid precursor to nonionic surfactant in the initial liquid component.

Solids

The fluid detergent product may optionally comprise dissolved solids and/or finely divided solids which are dispersed therein, such as, for example, inorganic neutralising agents and detergency builders.

The only limitation is that with or without dissolved or dispersed solids, the fluid detergent product should be pumpable.

Neutralising Agent

Anionic surfactant is formed in situ in the process stream by reaction of an appropriate acid precursor and an alkaline material such as an alkali metal hydroxide. In principle, any alkaline inorganic material can be used for the neutralisation of the anionic surfactant acid precursor but water-soluble alkaline inorganic materials are preferred.

In a preferred embodiment, the neutralising agent is a liquid or solution which is pumpable.

A preferred neutralising agent is sodium hydroxide. The latter normally must be dosed as an aqueous solution, which inevitably incorporates some water. Moreover, the reaction of an alkali metal hydroxide and acid precursor also yields some water as a by-product. Preferably, the aqueous sodium hydroxide solution has a concentration in the range from 40 to 60 wt %.

Another preferred neutralising agent is sodium carbonate, alone or in combination with one or more other water-soluble inorganic materials, for example, sodium bicarbonate or silicate.

It may be advantageous to produce a fluid detergent product which is alkali. For example, a pH in the range from 8.5 to 11.5. This has the advantage of ensuring the fluid is completely neutralised whilst not being of such a high level alkalinity that discoloration might occur.

Of course, the neutralising agent in addition to reacting with the anionic surfactant acid precursor can also neutralise other acid precursors that may be present, for example fatty acids (see below). Thus sufficient neutralising agent needs to be added to ensure complete neutralisation of all acid precursors if this is the case.

Organic neutralising agents may also be employed.

Water

In a preferred embodiment the fluid detergent product is substantially non-aqueous. That is to say, the total amount of water therein is not more than 15 wt % of the fluid detergent product, preferably not more than 10 wt %. However, if desired, a controlled amount of water may be added to facilitate neutralisation. Typically, the water may be added in amounts of 0.5 to 2 wt % of the final detergent product. Typically, from 3 to 4 wt % of the liquid binder may be water as the reaction by-product and the rest of the water present will be the solvent in which the alkaline material was dissolved. The fluid detergent product is very preferably devoid of all water other than that from the latter-mentioned sources, except perhaps for trace amounts/impurities.

Structurants

In a preferred embodiment of this invention, the fluid detergent product contains a structurant and fluid detergent products which contain a structurant are referred to herein as structured blends. All disclosures made herein with reference to fluid detergent products apply equally to structured blends.

A preferred application of the fluid detergent products of this invention is to contact them with a particulate detergent component in a mixer to form a particulate detergent product. In this respect, fluid detergent products are used either as liquid binders to agglomerate particles (e.g. powders) in a granulation process or simply contacted and absorbed onto carrier particles. The fluid detergent product may be pumped into the mixer containing particulate detergent material or may be introduced as a spray. Appropriate mixers, mixing regimes and process conditions for granulation and "absorption" processes are well know to those skilled in the art and are described for, example, in PCT published Applications WO00/77146 and WO00/77147.

In the context of the present invention, the term "structurant" means any component which enables the fluid detergent component to achieve solidification in the mixer containing the particulate detergent component, and hence, for example, good granulation, even if the solid component has a low liquid carrying capacity.

Structurants may be categorised as those believed to exert their structuring (solidifying) effect by one of the following mechanisms, namely: recrystallisation (e.g. silicate or phosphates); creation of a network of finely divided solid particles (e.g. silicas or clays); and those which exert steric effects at the molecular level (e.g. soaps or polymers) such as those types commonly used as detergency builders. One or more structurants may be used.

Structured blends provide the advantage that at lower ambient temperatures they solidify and as a result lend structure and strength to the particulate solids with which they are brought into contact, e.g. sprayed onto. It is therefore important that the structured blend should be pumpable, and preferably also sprayable, at an elevated temperature, e.g. at a temperature of at least 50° C., preferably of at least 60° C., and yet should solidify at a temperature below 50° C., preferably below 35° C. so as to impart its benefit.

The structurants cause solidification in the fluid detergent product preferably to produce a blend strength as follows. The strength (hardness) of the solidified fluid detergent component can be measured using an Instron pressure apparatus. A tablet of the solidified fluid detergent component, taken from the process before it contacts the particulate component, is formed of dimensions 14 mm in diameter and 19 mm in height. The tablet is then destroyed between a fixed and a moving plate. The speed of the moving plate is set to 5 mm/min, which causes a measuring time of about 2 seconds. The pressure curve is logged on a computer. Thus, the maximum pressure (at the moment of tablet breaking) is given and the E-modulus is calculated from the slope.

For the solidified fluid detergent component, $P_{max}$ at 20° C. is preferably a minimum of 0.2 M Pa, e.g. from 0.3 to 0.7 M Pa. At 55° C., a typical range is from 0.05 to 0.4 M Pa. At 20° C., $E_{mod}$ for the structured blend is preferably a minimum of 3 M Pa, e.g. from 5 to 10 M Pa.

Soaps represent one preferred class of structurant, especially when the structured blend comprises a liquid nonionic surfactant. In many cases it may be desirable for the soap to have an average chain length greater than the average chain length of the liquid nonionic surfactant but less than twice the average chain length of the latter.

It is very much preferred to form some or all of any soap structurant in situ in the fluid detergent product by reaction of an appropriate fatty acid precursor and an alkaline material such as an alkali metal hydroxide, e.g. NaOH. However, in principle, any alkaline inorganic material can be used for the neutralisation but water-soluble alkaline inorganic materials are preferred. All disclosures made herein to formation of anionic surfactant by neutralisation of the anionic surfactant acid precursor equally apply to the formation of soap in structured blends.

In a preferred embodiment, the initial liquid component comprises anionic acid precursor, nonionic surfactant and fatty acid (i.e. soap precursor).

Typical amounts of ingredients in the essential structured blend component as % by weight of the structured blend are as follows:

preferably from 98 to 10 wt % of anionic surfactant, more preferably from 70 to 30%, and especially from 50 to 30 wt %;

preferably from 10 to 98 wt % of nonionic surfactant, more preferably from 30 to 70 wt %, and especially from 30 to 50 wt %;

preferably from 2 to 30 wt % of structurant, more preferably from 2 to 20%, yet more preferably from 2 to 15 wt %, and especially from 2 to 10 wt %.

In addition to the anionic surfactant, nonionic surfactant and structurant, the structured blend may also contain other organic solvents.

The invention will now be explained in more detail by way of the following non-limiting example

EXAMPLE

The following is an example of a single pass process for the preparation of a fluid detergent product comprising LAS, nonionic and soap.

In a first step, LAS acid and a blend of nonionic surfactants; $C_{10}$ alcohol polyethylene glycol polyether (3 EO) and $C_{10}$ alcohol polyethylene glycol polyether (7 EO) were pumped using positive displacement pumps from separate storage vessels into a pre-mixer; a static mixer of the Sulzer type to form an initial liquid component. The flow was monitored with Mass flow meters of the Mico Motion Type. The weight ratio of LAS acid to nonionic surfactant blend was in the range 6:7 to 10:3.

The initial liquid component from the pre-mixer was passed through a plate heat exchanger to control the temperature of the initial liquid component at about 60° C.

After the plate heat exchanger, a 50% w/v caustic solution was dosed continuously into the initial liquid component and the resulting process stream fed into a first static in-line mixer. The amount of caustic neutralising agent added was sufficient to neutralise about 30–50% of the combined LAS acid and fatty acid content of the initial liquid component. The caustic was dosed using a positive displacement pump controlled by a mass flow meter.

The partially neutralised process stream leaving the first mixer was cooled to about 60° C. by passing it through a second plate heat exchanger. A this point in the process, sufficient caustic solution was continuously dosed into the cooled process steam to complete neutralisation and the mixture subsequently fed into a second mixer; a dynamic in-line mixer. The temperature of the blend leaving the second mixer was about 90–95° C. The blend was of good color and fully neutralised.

What is claimed is:

1. A continuous process for the preparation of a fluid detergent product containing an anionic surfactant, comprising mixing an initial liquid component comprising the anionic surfactant acid precursor with sufficient neutralising agent to substantially complete neutralisation of the anionic surfactant acid precursor characterised in that (i) the initial liquid component is fed to a first mixing device with sufficient initial neutralising agent to neutralise 25–75 wt % of the anionic surfactant acid precursor, and (ii) the partially neutralised process stream from step (i) is fed through one or more subsequent mixing devices with sufficient further neutralising agent to substantially complete neutralisation by the time the fluid process stream exits the final mixing device, wherein the process stream comprising the initial neutralising agent is actively cooled by a cooling means prior to the addition of any further neutralising agent, and the initial liquid component and process stream are kept at a temperature above the pumpable temperature at all times during the process.

2. A process according to claim 1, in which the process stream from step (i) is fed through just one subsequent mixing device.

3. A process according to claim 1 in which the cooling means is positioned between the first mixing device and the subsequent mixing device.

4. A process according to claim 1, in which sufficient initial neutralising agent to neutralise 30–70 wt % of the anionic surfactant acid precursor is fed to the first mixing device.

5. A process according to claim 1, in which the neutralisation time is less than 5 minutes.

6. A process according to claim 1, in which the temperature of the initial liquid component and the process stream is maintained below 120° C. during the process.

7. A process according to claim 1, in which the initial and/or further neutralising agent is a water-soluble alkaline inorganic salt.

8. A process according to claim 7, in which the water-soluble alkaline inorganic salt is sodium hydroxide or sodium carbonate.

9. A process according to claim 8, in which the sodium hydroxide is fed into the process as a 40 to 60 wt % aqueous solution.

10. A process according to claim 1, in which the anionic surfactant acid precursor is a linear alkyl benzene sulphonic (LAS) acid.

11. A process according to claim 1, in which the initial liquid component comprises a nonionic surfactant.

12. A process according to claim 1, in which the initial liquid component comprises a structurant.

13. A fluid detergent product obtainable by the process of claim 1.

14. A process according to claim 1, in which sufficient initial neutralising agent to neutralise 35–65 wt % of the anionic surfactant acid precursor is fed to the first mixing device.

15. A process according to claim 1, in which the neutralisation time is less than 3 minutes.

16. A process according to claim 1, in which the temperature of the initial liquid component and the process stream is maintained below 110° C. during the process.

* * * * *